US008341918B2

(12) United States Patent
Jolly

(10) Patent No.: US 8,341,918 B2
(45) **Date of Patent: *Jan. 1, 2013**

(54) SYSTEM AND METHOD FOR ERECTING A TOWER

(76) Inventor: Tony Jolly, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/236,205

(22) Filed: Sep. 19, 2011

(65) Prior Publication Data

US 2012/0285118 A1 Nov. 15, 2012

Related U.S. Application Data

(62) Division of application No. 12/291,724, filed on Nov. 13, 2008, now Pat. No. 8,042,306.

(60) Provisional application No. 61/003,246, filed on Nov. 15, 2007.

(51) Int. Cl.
*E04H 12/34* (2006.01)

(52) U.S. Cl. ..... 52/745.2; 52/745.18; 52/745.17; 52/745.11

(58) Field of Classification Search ..... 52/127.1, 52/127.2, 122.1, 745.17, 123.1, 173.1, 750, 52/745.11, 745.18, 745.2
See application file for complete search history.

(56) References Cited

U.S. PATENT DOCUMENTS

| | | | |
|---|---|---|---|
| 2,267,705 | A | 12/1941 | Athy |
| 2,370,661 | A | 3/1945 | Hayes |
| 2,423,301 | A | 7/1947 | Fairchild |
| 2,831,592 | A | 4/1958 | Syracuse |
| 2,848,196 | A | 8/1958 | Simmonds |
| 2,857,994 | A | 10/1958 | Sheard |
| 2,863,531 | A | 12/1958 | Campbell |
| 2,993,570 | A | 7/1961 | Bender |
| 2,998,106 | A | 8/1961 | Aust |
| 3,033,526 | A | 5/1962 | Priest |
| 3,034,661 | A | 5/1962 | Pollack et al. |
| 3,045,837 | A | 7/1962 | Hans et al. |
| 3,233,375 | A | 2/1966 | Durand |
| 3,320,703 | A | 5/1967 | Hawthorn et al. |

(Continued)

FOREIGN PATENT DOCUMENTS

| | | | |
|---|---|---|---|
| GB | 1282240 | A | 7/1972 |

(Continued)

OTHER PUBLICATIONS

Office Action Feb. 2, 2011 for U.S. Appl. No. 12/291,724.

*Primary Examiner* — William Gilbert
*Assistant Examiner* — Alp Akbasli
(74) *Attorney, Agent, or Firm* — D'Ambrosio & Menon, PLLC

(57) ABSTRACT

A method, a system, and a device for erecting a tower. The method comprises assembling proximate to the ground a base section, top section, and one or more intermediate sections of the tower into an assembled tower lying in a substantially horizontal first plane, the assembled tower comprising a top end including the top section and a bottom end including the base section. The method also includes orienting the attitude of the assembled tower using a lift initiator to lie in a second plane defining an acute angle to the first plane, so that the top end of the tower is higher in elevation than the bottom end. The method also includes lifting the assembled tower from the second plane to a vertical plane with a primary lift assembly and coupling the assembled tower to the foundation.

16 Claims, 12 Drawing Sheets

U.S. PATENT DOCUMENTS

| | | | | |
|---|---|---|---|---|
| 3,495,370 | A | 2/1970 | Habro et al. | |
| 3,606,713 | A | 9/1971 | Runquist | |
| 3,694,893 | A | 10/1972 | Ashida | |
| 3,715,852 | A | 2/1973 | Koga et al. | |
| 4,021,978 | A | 5/1977 | Busse et al. | |
| 4,028,792 | A | 6/1977 | Tax et al. | |
| 4,039,174 | A | 8/1977 | Poff et al. | |
| 4,231,200 | A | 11/1980 | Henderson | |
| 4,269,395 | A | 5/1981 | Newman et al. | |
| 4,590,718 | A | 5/1986 | Angeloff | |
| 4,594,044 | A | 6/1986 | Soot | |
| 4,598,509 | A | 7/1986 | Woolslayer et al. | |
| 4,785,309 | A | 11/1988 | Gremillion | |
| 4,932,175 | A | 6/1990 | Donnally | |
| 5,247,776 | A | 9/1993 | Tamayo | |
| 5,509,502 | A | 4/1996 | Beaulieu | |
| 5,674,040 | A | 10/1997 | Wagner | |
| 5,758,785 | A | 6/1998 | Spinosa et al. | |
| 5,807,059 | A | 9/1998 | Takeda | |
| 6,065,620 | A | 5/2000 | McGhie | |
| 6,301,841 | B1 | 10/2001 | Rhebergen et al. | |
| 6,408,575 | B1 | 6/2002 | Yoshida et al. | |
| 6,592,297 | B2 * | 7/2003 | Frijns et al. | 405/170 |
| 6,782,667 | B2 | 8/2004 | Henderson | |
| 6,796,742 | B1 | 9/2004 | Roger et al. | |
| 6,843,030 | B2 | 1/2005 | Zingerman | |
| 6,926,259 | B1 * | 8/2005 | Roodenburg et al. | 254/277 |
| 7,306,055 | B2 | 12/2007 | Barnes | |
| 7,849,965 | B2 | 12/2010 | May | |
| 2002/0095878 | A1 * | 7/2002 | Henderson | 52/116 |
| 2003/0029825 | A1 | 2/2003 | Baxter, Sr. | |
| 2007/0290182 | A1 * | 12/2007 | Noeske et al. | 254/327 |
| 2008/0008588 | A1 | 1/2008 | Hartman | |
| 2008/0078128 | A1 * | 4/2008 | Livingston et al. | 52/40 |
| 2009/0056953 | A1 * | 3/2009 | Korach et al. | 166/386 |
| 2009/0084558 | A1 * | 4/2009 | Bloom | 166/385 |

FOREIGN PATENT DOCUMENTS

| | | |
|---|---|---|
| NL | 99065 | 9/1961 |
| WO | 0206552 A1 | 6/2002 |

* cited by examiner

SYSTEM AND METHOD FOR ERECTING A TOWER

PRIORITY CLAIM

This application is a divisional of U.S. application Ser. No. 12/291,724, filed Nov. 13, 2008, which claims benefit of Provisional U.S. Patent Application No. 61/003,246, for, System and Method for Erecting a Tower, the entire disclosures of which are incorporated by reference.

FIELD OF THE INVENTION

The present invention relates generally to systems, devices, and methods for erecting towers.

BACKGROUND

Expanding industry and an increasing number of applications have caused growth in the number of towers of great height (for example, a height of 75 feet or more). Typical applications include towers for power transmission, telecommunications, and industrial use. However, the capacity to build new towers is hampered by current construction methods, which are costly and time-consuming, and which rely on the availability of specialty equipment.

Current methods require constructing the tower in sections to achieve a vertical position. Typically, a large crane is brought to the construction site, where the crane is used to lift segments of the tower, one-by-one, into place on top of each other. Because of the height of the towers, typically varying between 120 and 400 feet, the present systems cannot raise and stabilize the tower without doing it in sections. Each section must be lifted to a height with a crane, using taller and taller cranes, and then secured into place at that height. This process usually requires long periods of time to complete. Furthermore, constructing towers using current techniques often requires taking advantage of small windows of time where the wind is sufficiently still to raise, place and attach consecutive sections.

These disadvantages, while ubiquitous to tower construction in general, are compounded by the requirements of certain tower applications. One such application is wind turbine towers. The need for wind turbine towers has increased as harnessing wind energy has gained acceptance as a viable means of generating electrical power for industrial and consumer uses. Large scale capture and conversion of wind energy requires the placement of wind turbines at a suitable elevation above the ground to capture the wind flow free from the interference and turbulence caused by the surface of the surrounding terrain. To achieve placement at such height, towers of great size are used to support the wind turbines. Due to the relatively small electrical generation capacity of each individual wind turbine, numerous towers are required.

By their nature, optimal wind turbine tower sites are usually subject to high winds, which exacerbates the problem of completing construction during the "low-wind" time window. Further, moving a crane onto the typical wind turbine construction site can be quite difficult since many wind turbine construction sites are in remote locations far from improved roads. Existing roads to the site may not have sufficient bearing strength to support the transit weight of the large crane required by current methods. Thus, roads to the construction site are built or improved to allow the construction cranes to be brought on site. In some cases, these roads must also be removed after construction due to limitations on land leases and rights-of-way. The required construction (and subsequent removal) of these roads creates a large collateral cost to the wind turbine tower construction.

SUMMARY

Disclosed herein are methods, systems, and devices for erecting a tower. In one embodiment, the method comprises assembling proximate to the ground a base section, top section, and one or more intermediate sections of the tower into an assembled tower lying in a substantially horizontal first plane, the assembled tower comprising a top end including the top section and a bottom end including the base section. The method also comprises orienting the attitude of the assembled tower to lie in a second plane defining an acute angle to the first plane, so that the top end of the tower is higher in elevation than the bottom end. A pushing mechanism or lift initiator is used to lift the assembled tower to the second plane. The method further comprises lifting the assembled tower from the second plane to a vertical plane with a pulley system and finally coupling the assembled tower to the foundation. In one embodiment of this invention, the pulley system may comprise a primary lift assembly. The primary assembly may include a continuous loop of cable connected to a counter-balanced tackle-block system. The tower may be a tower of great height.

One embodiment is a method for erecting a wind turbine tower. The wind turbine tower includes a base section, a top section, one or more intermediate sections between the base section and the top section, and a nacelle. The method includes a first step of assembling proximate to the ground the base section, the top section, the one or more intermediate sections and the nacelle into an assembled wind turbine tower lying in a substantially horizontal first plane. The method may also include attaching a rotor to the nacelle. The assembled wind turbine tower comprises a top end including the top section and a bottom end including the bottom section. During the method the assembled wind turbine tower is raised to lie in a second plane defining an acute angle to the first plane so that the top end of the wind turbine tower is higher in elevation than the bottom end. A pushing mechanism or lift initiator can be used to raise the assembled wind turbine tower. The assembled wind turbine tower is then lifted from the second plane to a vertical plane using a pulley system such as a primary lift assembly. The assembled wind turbine tower can then be coupled to the foundation.

One embodiment of the present invention comprises a system for temporarily reinforcing an assembled tower to assist the lifting of the assembled tower to a vertical plane position from an angle that is acute to the horizontal plane. The tower includes a top, a middle, and a bottom. The system includes a cable and a tension mechanism. The cable includes a middle, a first end, and a second end. The first and second ends are connected to the top and the bottom of the tower respectively. The tension mechanism is configured to apply force to the middle of the tower using the middle of the cable as a reaction point. The tension mechanism may include a hydraulic cylinder positioned at substantially the middle of the tower and oriented substantially perpendicular to the tower.

One embodiment is a method for preparing a pulley system for erecting an assembled tower. The assembled tower includes a top, a middle, and a bottom. The method includes setting a first anchor point and a second anchor point. The method also includes connecting a stationary block connected to the first anchor point and connecting a first tensioning system to the stationary block. The method also includes connecting a counter-lift block to the second anchor point and connecting a second tensioning system to the counter-lift block. The method also includes passing a continuous loop of cable through the stationary block and the counter-lift block and coupling the continuous loop of cable to the top of the assembled tower on two opposing sides. Coupling the continuous loop of cable to the top of the assembled tower on two opposing sides may be carried out by coupling the continuous loop of cable to the top of the assembled tower on a first side with a first set of traveling blocks. Coupling the continuous loop of cable to the top of the assembled tower on two opposing sides may also include coupling the continuous loop of cable to the top of the assembled tower on a second side opposite the first side with a second set of traveling blocks.

One embodiment is a system for first assembling a tower on the ground prior to erecting or raising the tower to a position perpendicular to the ground. The tower, once it is assembled, comprises a top, a middle, and a bottom. The system comprises a lift initiator adapted to raise the assembled tower vertically from a substantially horizontal first plane to a second plane defining an acute angle to the first plane. The system also comprises a primary lift assembly adapted to lift the assembled tower from the second plane to a vertical plane. The system can also include a setting trolley adapted to orient the assembled tower at least one of vertically, rotationally, and axially after the assembled tower is lifted to the vertical plane by the lift initiator and the primary lift assembly. At least one stabilizer is used within this system to prevent lateral movement while the assembled tower is lifted by the lift initiator and primary lift assembly.

The foregoing and other objects, features and advantages of the disclosure will be apparent from the following more particular descriptions of exemplary embodiments of the invention as illustrated in the accompanying drawings wherein like reference numbers generally represent like parts of exemplary embodiments of the invention.

DETAILED DESCRIPTION OF THE INVENTION

The present invention relates to methods, systems, and devices for erecting a tower. Aspects of the disclosed invention are useful for erecting a tower of great height—that is, 50 feet or more in height. The method and system disclosed herein are especially useful in erecting towers of more than 100 feet, particularly towers ranging up to 450 feet. The tower may be a telecommunications tower, a power transmission tower, drilling towers for oil and gas wells or water wells, a petroleum refining structure (e.g., a reactor vessel), and so on. In one embodiment, illustrated with reference to FIG. 1C, the assembled tower is a wind turbine tower with the nacelle installed. Towers of great height may be transported as sections. In the present invention, the tower is first constructed on the ground to its full size by assembling the sections, and then raised from a horizontal position to a vertical position using a system of lift assemblies, stabilizers and positioning mechanisms. Assembling the tower may be carried out by bolting flanges of the tower sections together or by other means as will occur to those of skill in the art. Alternatively, the tower may be partially or fully assembled before transport to the site and erected according to the systems and methods disclosed herein. The sections are quickly and easily connected while on the ground, either before or after transport. One advantage of this invention is that, after the tower is constructed, the entire tower is raised from a horizontal position to a vertical position in two lifting movements, using a lift initiator to first raise the tower to a mechanically advantageous position and a second lift mechanism to finish the lift to final positioning.

Figure 1A:
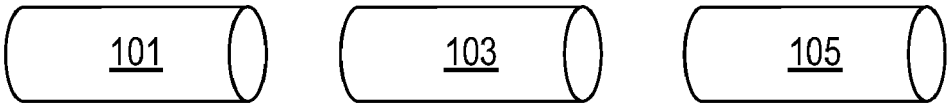
FIG. 1A is a side view of sections of a tower before assembly.
Figure 1B:
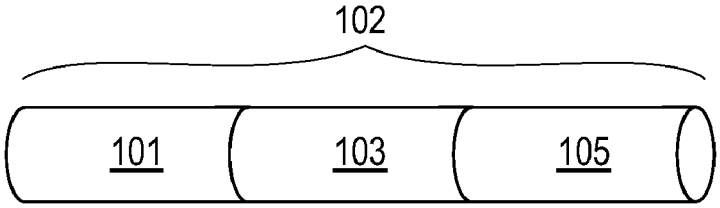
FIG. 1B is a side view an assembled tower including a top section, a base section, and an intermediate section.
Figure 1C:
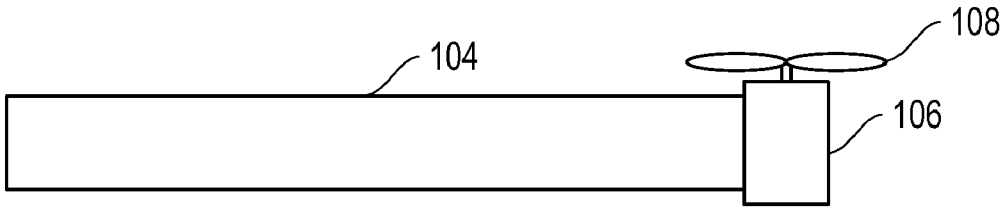
FIG. 1C is a side view of an assembled tower including a nacelle and a rotor.
Figure 2A:
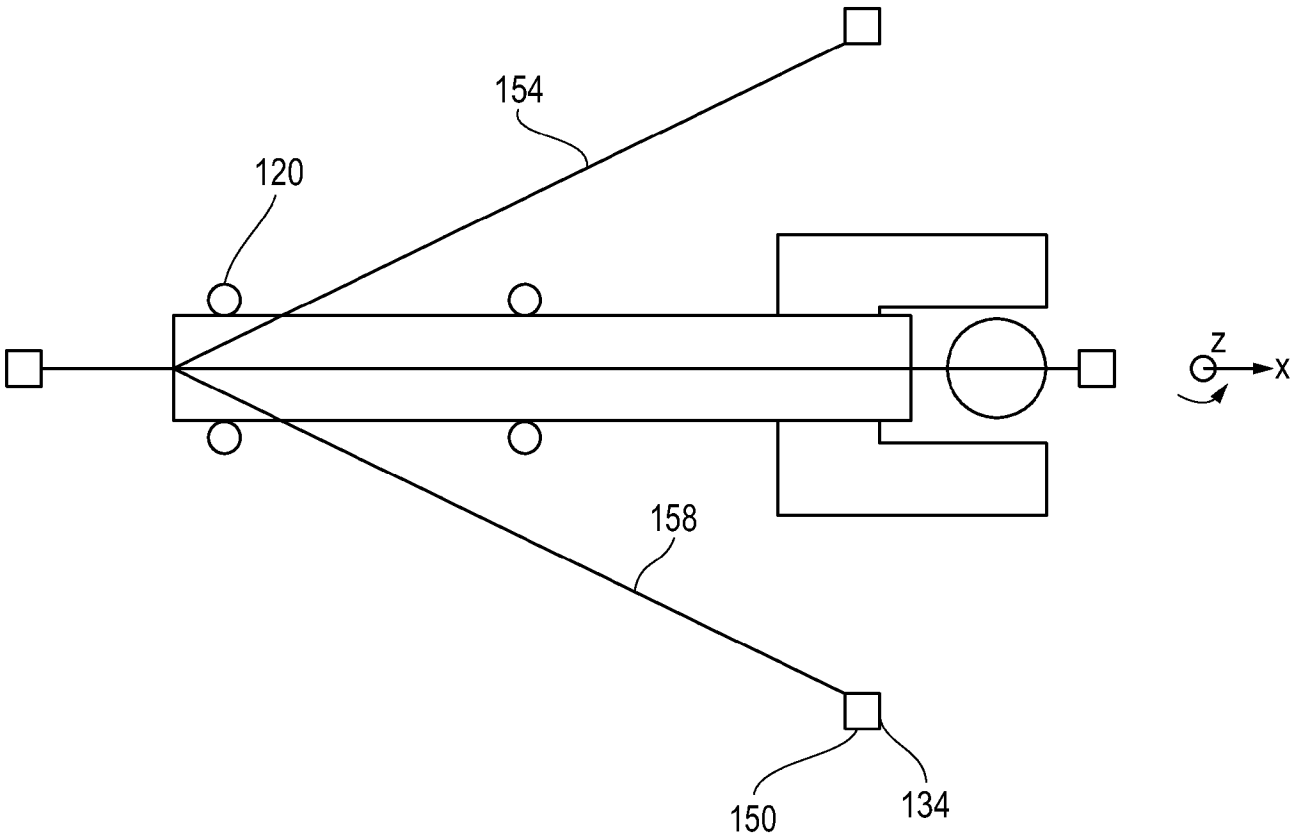
FIG. 2A is a top view of a system for erecting a tower, according to an embodiment of the invention.
Figure 2B:
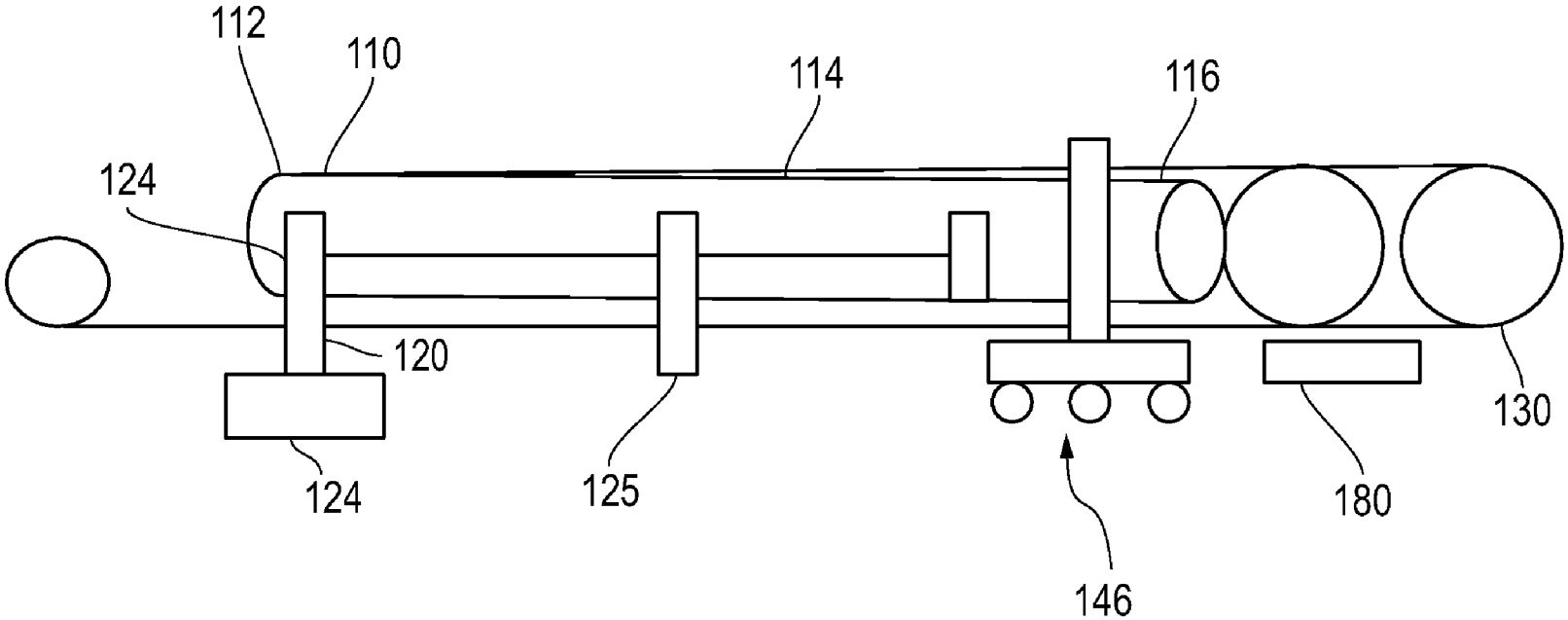
FIG. 2B is a side view of a system for erecting a tower, according to an embodiment of the invention.
Figure 3:
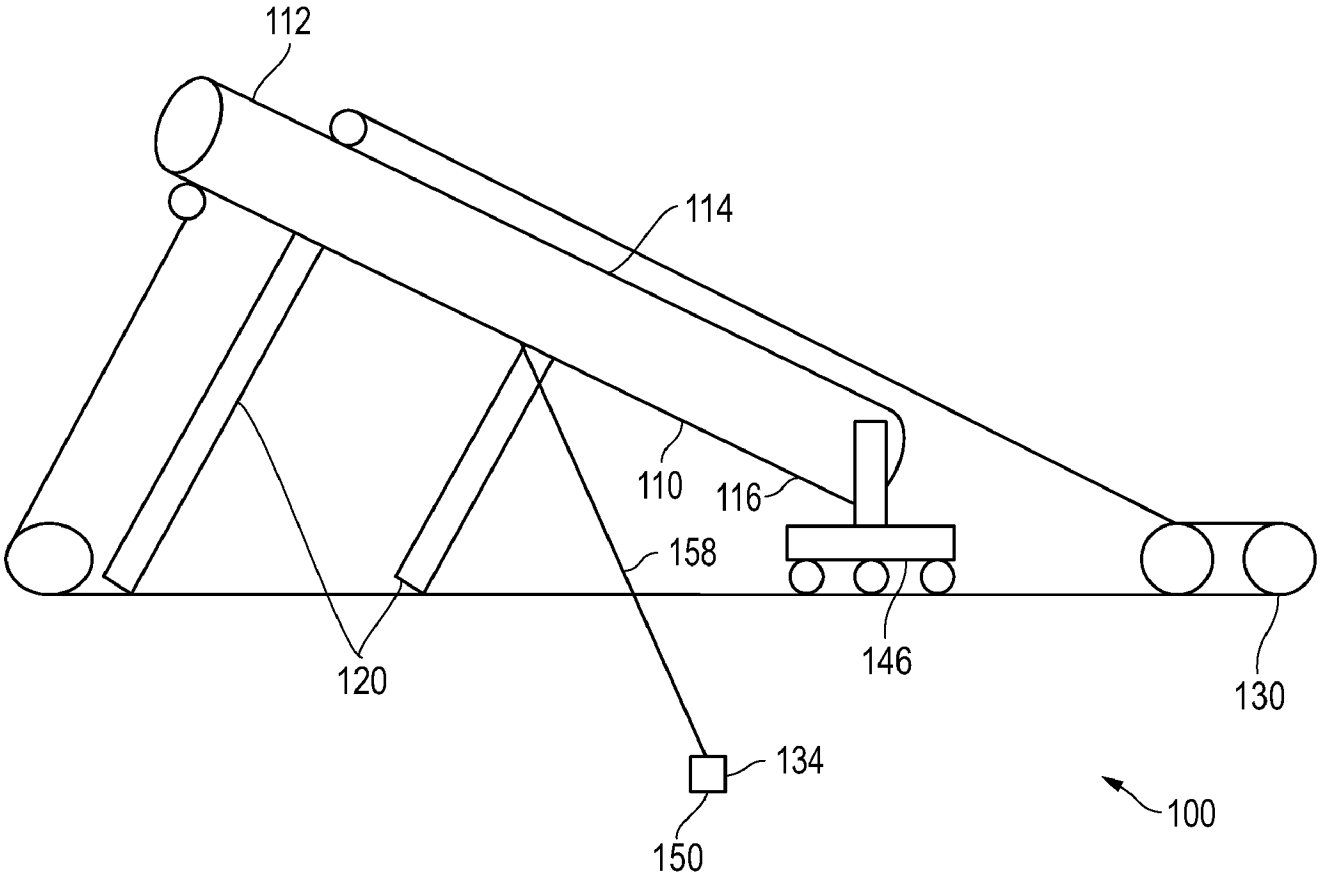
FIG. 3 is a side view of a system for erecting a tower at a point of mid-lift, according to an embodiment of the invention.
Figure 4:
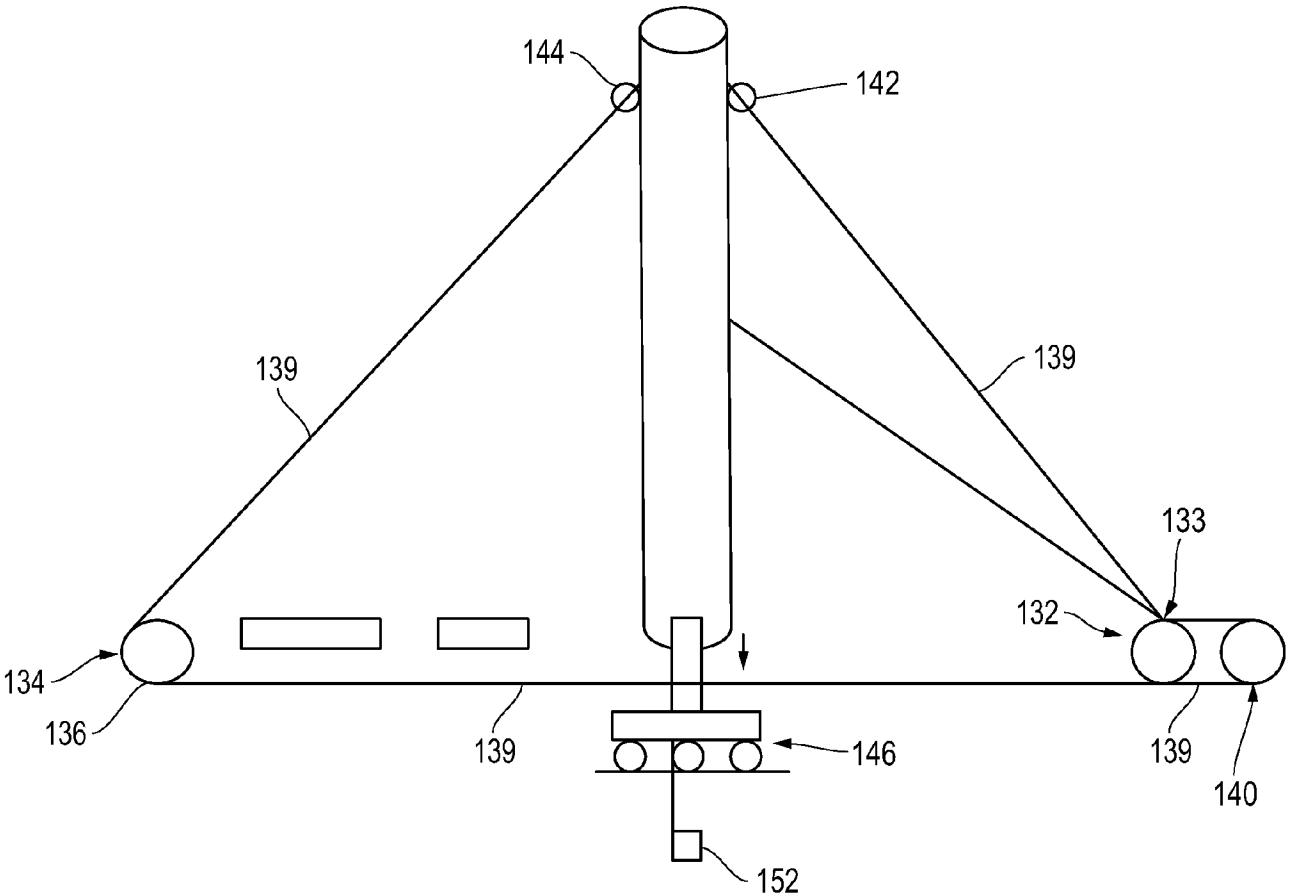
FIG. 4 is a side view of a system for erecting a tower at a point of final or vertical position, according to an embodiment of the invention.

FIG. 1A illustrates the sections of a tower, including a base section 101, an intermediate section 103, and a top section 105. As shown in FIG. 1B, after assembly, the sections form an assembled tower 102. As shown in FIG. 1C, if the tower 102 is a wind turbine tower, the assembled tower 104 may also include a nacelle 106 and a rotor 108. FIGS. 2A-4 illustrate a system for erecting a tower. Referring to FIGS. 2A, 3 and 4, the system comprises, among other elements a lift initiator such as pushing mechanism 120 and a pulley system such as a primary lift assembly 130. An assembled tower 110, comprising a top 112, a middle 114, and a bottom 116, is shown first lying on the ground in a horizontal position (FIG. 2A), then mid lift (FIG. 3), and finally, in a vertical position (FIG. 4). After the tower is assembled, the entire tower is raised from a horizontal position to a vertical position in two lifting movements, using the push mechanism 120 (or other lift initiator) to first raise the assembled tower to a first mechanically advantageous position and the primary lift assembly 130 to finish the lift to a final, vertical positioning. By avoiding the piecewise assembly of the tower in a vertical position, the weather-sensitive lift time is shortened, thereby preventing delays. Another advantage of horizontal assembly is that it allows the tower sections to be bolted under portable shelters allowing connections to be made in a controlled environment that is less sensitive to weather conditions (snow, rain, wind). The primary lift assembly of this invention may be driven by any mechanism that provides a pulling force (e.g., a winch), so that a large crane is not required.

Returning to FIGS. 2A-4, the pushing mechanism 120 begins the lifting process. The pushing mechanism 120 can work independently of the primary lift system, and is adapted to lift the assembled tower vertically from a first plane, which is horizontal or close to the ground, to a second plane defining an acute angle to the first plane. In other embodiments, other lift initiators, such as pulley systems or levers, may be used to orient the assembled tower to the second plane. Attempting to raise a large tower that is anywhere from 50 feet to 450 feet is challenging because the large mass creates a large bending moment. The force that is required, especially when attempting to lift the tower from a horizontal to a vertical position is great. A pushing force using the mechanical advantage of a hydraulic system can raise the tower to an angle from the horizontal. As the tower is raised to an angle above the horizontal, less force is necessary to continue raising it to the vertical. A pulley system can now be used to pull the tower to a vertical position. In one aspect, the lift initiator 120 includes a push-mechanism elevator 124 to lift the top of the tower 112 away from the first plane (as seen in FIG. 2B) to the second plane (as seen in FIG. 3) at an angle to the horizon. Examples of suitable push-mechanism elevators 124 include a lifting jack, a rotating screw, a pneumatic system, a scissor-lift system, or a combination of these. For towers of great height, over 100 feet, the push-mechanism elevator 124 alone cannot lift the tower to a vertical position. A pulley system such as the primary lift assembly 130 is utilized to lift the tower 110 from the second plane, or mid-lift position, illustrated in FIG. 3, to the vertical plane, as seen in FIG. 4.

In some embodiments, the primary lift assembly 130 comprises a counter-balanced tackle-block system utilizing a winch 140 and cable system to elevate the tower 110 to the vertical position. A first stationary block 133 is connected to a first anchor point 132 and a counter-lift block 136 is connected to a second anchor point 134. Anchor points are selected for optimum stabilizing of the tower 110 in position. A continuous loop of cable 139 passes through the stationary block 133 and the counter-lift block 136.

Opposite ends of the cable are connected to the top of the assembled tower 110 on two opposing sides. In some embodiments, either one or both of the ends of the cable may be connected directly to the top of the assembled tower 110. In other embodiments, either or both ends of the cable may be connected to the top of the tower through a set of traveling blocks for added mechanical advantage, in which case the cable may pass through one or more traveling blocks and then terminate (being connected to an anchor or otherwise secured) as a static line. A drive system, such as a winch, is operatively coupled with the cable for driving the cable until the assembled tower is in the vertical position.

For example, in the system of FIGS. 3 and 4, a first set of traveling blocks 142 connects the cable to the top of the tower 112; and a second set of traveling blocks 144 opposite the first set of traveling blocks 142 connects the cable to the top of the tower 112 opposite the first set of traveling blocks. Static lines are not shown. A winch 140 drives the continuous loop of cable 139 to complete the erection of the tower 110 by lifting the tower from the mid-lift to vertical.

The system is configured so that as the length of the cable connected to the side of the tower closest to the stationary block is pulled in the direction of the lift and reeled through the stationary block, a correlating length of cable is spooled from the counter-lift block on the opposite side. This configuration provides a mechanical advantage for the lift and maintains proper tension so that the tower is lifted with precise control.

In the embodiment of FIGS. 3 and 4, the primary lift assembly 130 includes a connection between pulley blocks on the towers 142, 144 and anchors 134 on the ground to guide and stabilize the tower during the erecting process. A first tensioning system (not shown) may be connected to the first stationary block 133. A second tensioning system (not shown) may be connected to the counter-lift block 136. The tensioning system is described in greater detail below, with reference to FIG. 5. The system of FIGS. 3 and 4 also includes stabilizers. A stabilizer may include one or more anchors 134, one or more guy lines 158 connected from the anchors 134 to the top of the tower 112, and a third tensioning system connected to the guy lines 158.

Figure 5:
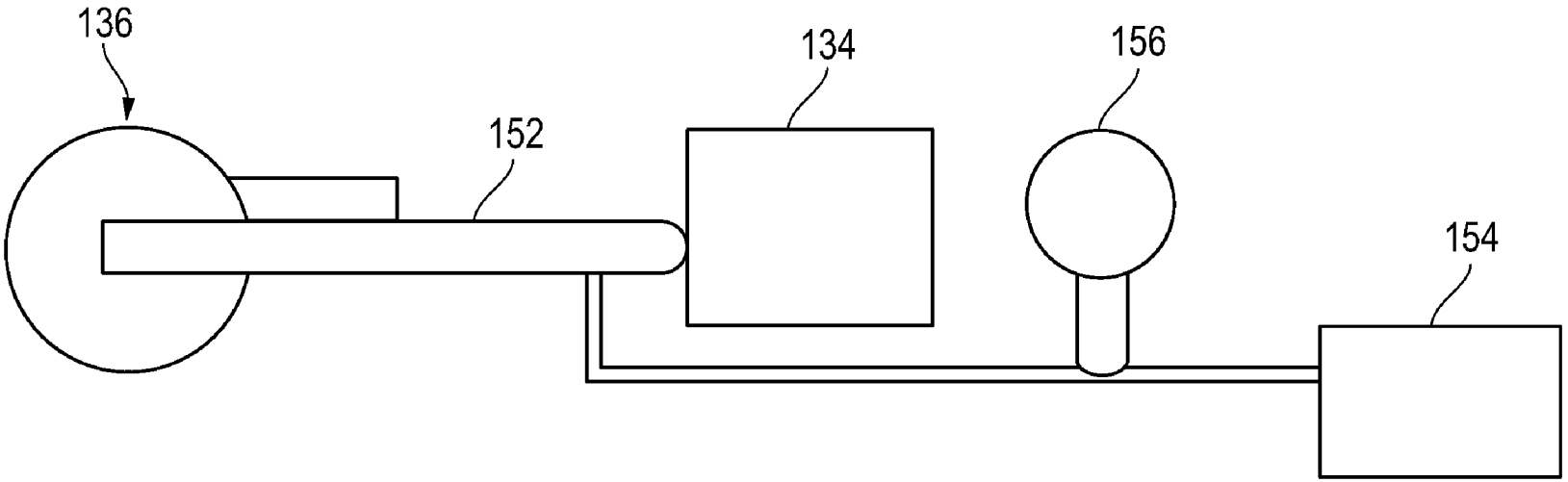
FIG. 5 is a schematic illustrating a system for tensioning a cable.
Figure 6A:
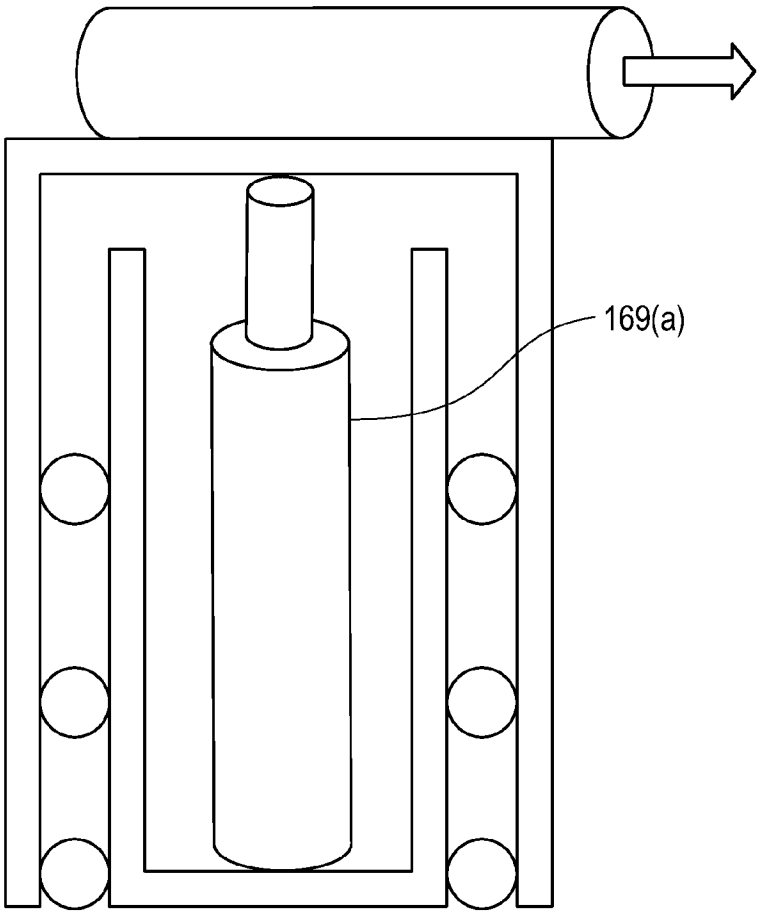
FIGS. 6*a* and 6*b* are schematics illustrating details of the lifting jacks on the setting trolley.
Figure 6B:
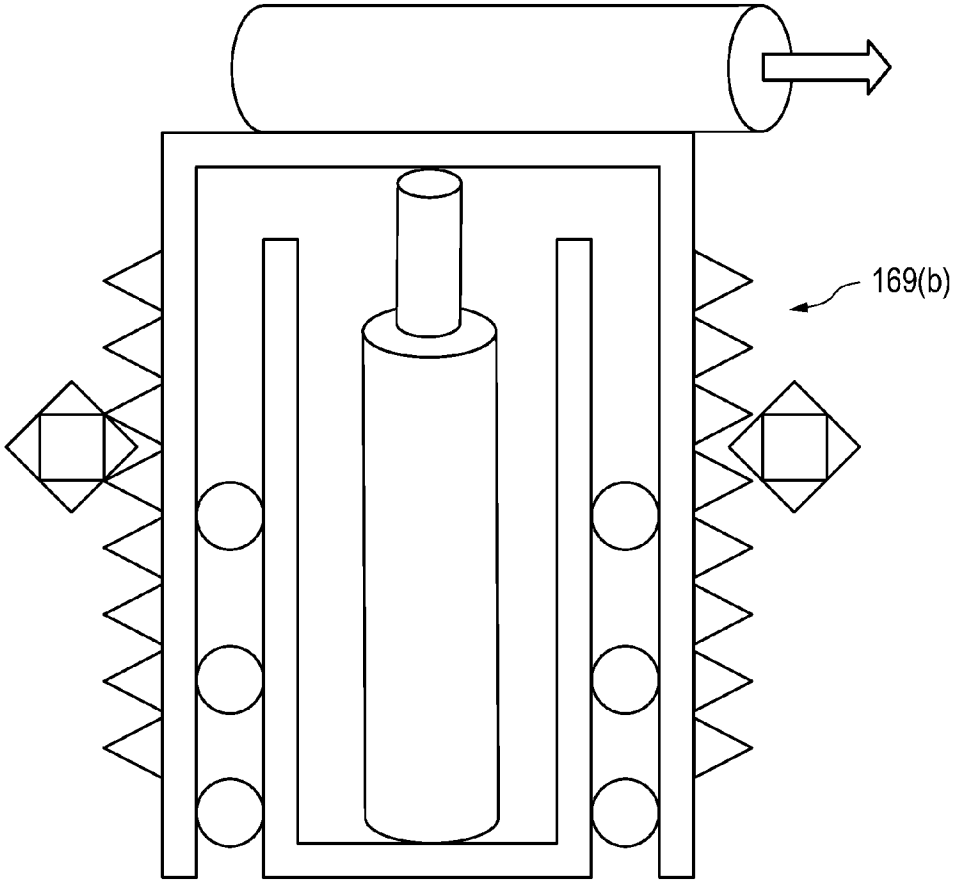

As seen in FIG. 5, each tensioning system comprises: a tensioning cylinder 152; a power pack 154 supplying power for the tensioning cylinder 152 and one or more accumulators 156 adapted to store power from the power pack 154 and regulate force applied to the cable drive 130. The tensioning systems may be used to generally regulate tension in the cable. In one aspect, the tensioning system may be used to counteract increases or decreases in tension caused by movement of the cable through various pulleys and blocks in the system.

In addition to the elements described above, the primary lift system may include other elements for hoisting the tower 110 from the mid-lift position to vertical, such as, for example, winches and tuggers with or without the use of boom extensions to gain a mechanical advantage.

Figure 7A:
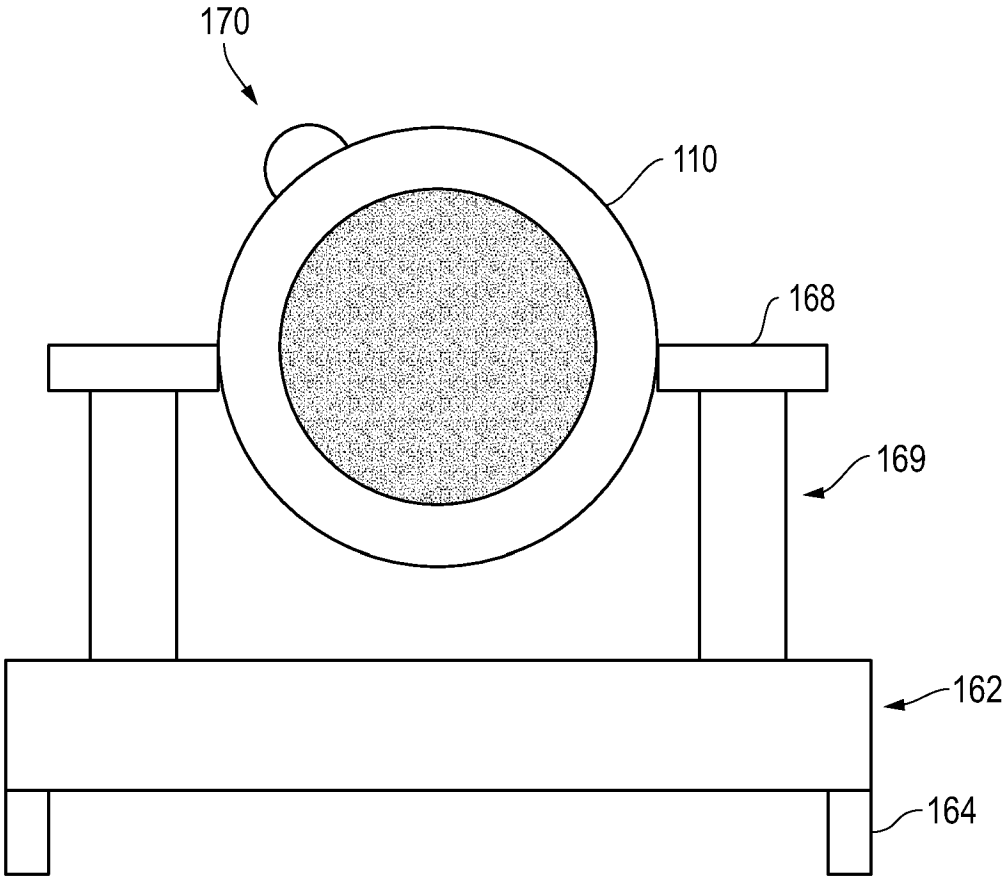
FIGS. 7*a* and 7*b* are schematics illustrating the setting trolley and rotating mechanism.
Figure 7B:
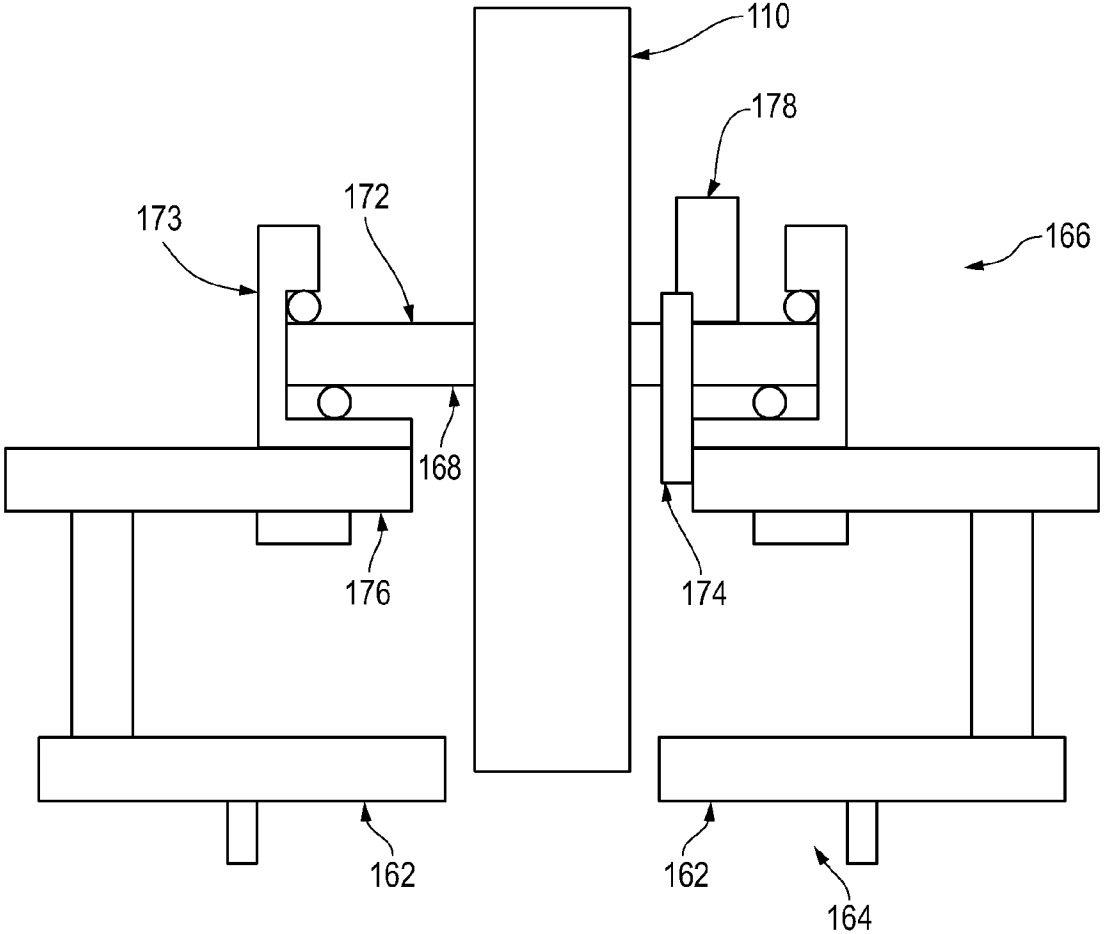

FIGS. 7A and 7B illustrate a setting trolley 146 used to orient the tower vertically, rotationally, and axially. In one embodiment, the setting trolley 146 is configured to orient the tower as the tower 110 is elevated by the lift initiator 120 and the lift assembly 130, while in other embodiments they orient the tower after the lift. The setting trolley allows for proper alignment of the tower for coupling to a foundation, as discussed in greater detail below. To this end, the setting trolley 146 has a platform 162, a locomotion assembly 164 to move the platform in one axis horizontally, a positioning table 166 connected to the platform 162, a connector 168 coupling the bottom of the tower 116 to the positioning table 166, and a vertical alignment actuator 169 to position the tower vertically through the positioning table 166. In one aspect, the locomotion assembly 164 is selected from wheels, tracks, slides, casters, and combinations thereof.

FIG. 7A illustrates one embodiment of a positioning table according to the present invention. To orient the tower 110 rotationally, the positioning table 166 includes a rotational mechanism 170 that rotates the tower 110 about a vertical axis. The positioning table 166 also includes a rotating ring 172 comprising a center axis attached to the bottom of the tower 116. A drive shaft 174 including a main shaft and a pinion can be affixed to the rotating ring 172 parallel to, but offset from, the central axis of the ring gear. A stationary ring gear 176 comprising a central axis and an inner face is also included on the positioning table 166. The inner face of the stationary ring gear 176 has a series of gear teeth positioned such that the drive shaft pinion interfaces with the gear teeth. A drive motor 178 connects to the drive shaft 174 for the purpose of causing the drive shaft 174 to rotate. In this system, the vertical alignment actuator may include a hydraulic jack, a rack and pinion jack, a screw jack, a combination of these, and so on.

Figure 8:
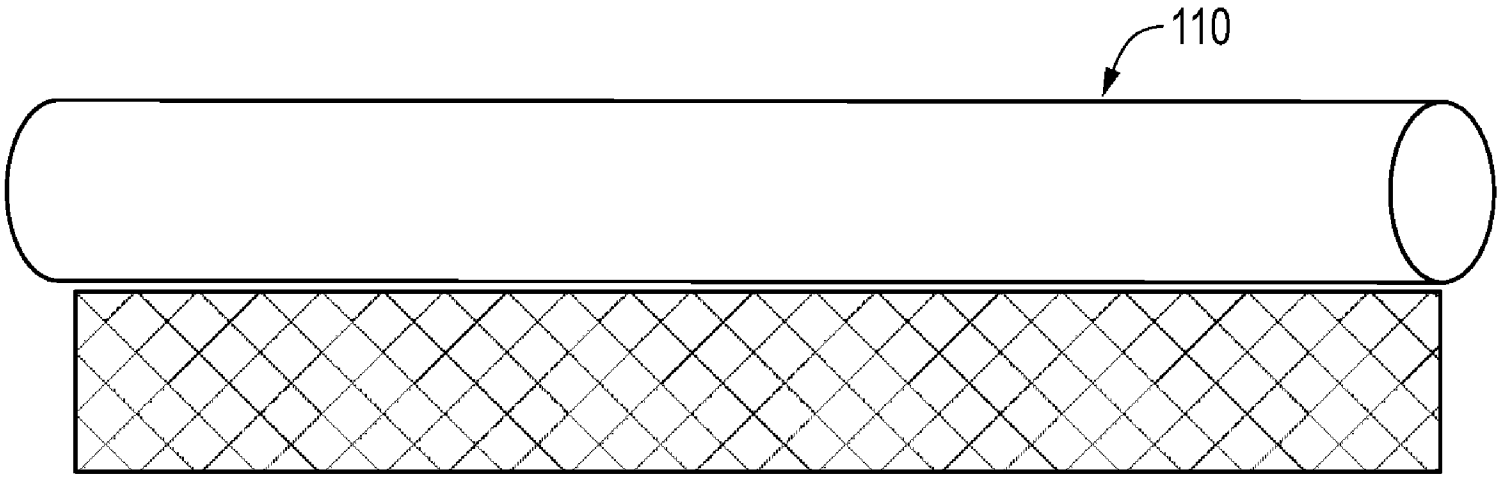
FIG. 8 is a side view of the tower showing the possible addition of a removable support structure to stabilize the tower during lifting.
Figure 9:
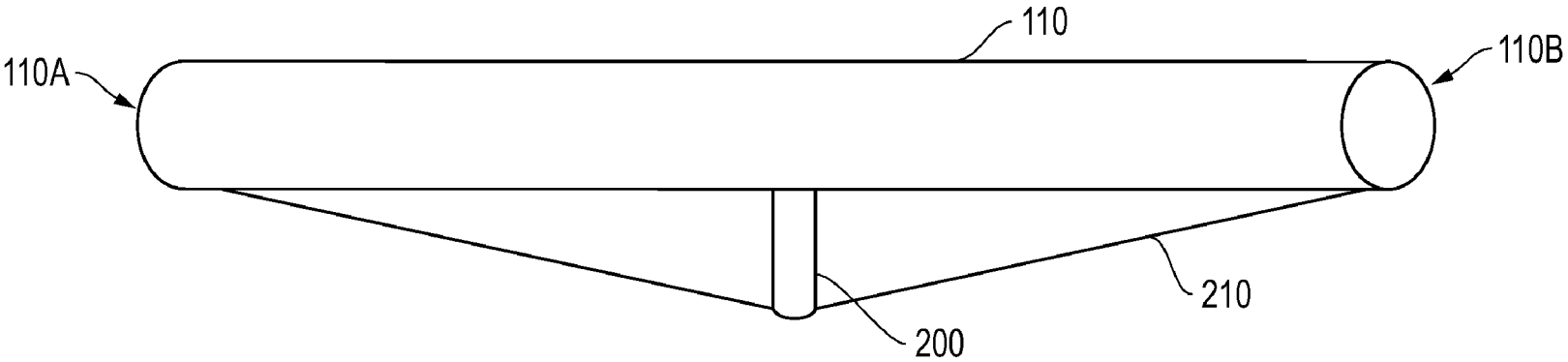
FIG. 9 is a side view of the tower showing a removable external structure.

Referring to FIG. 8, a framework is used for reinforcing the tower 110. The framework of FIG. 8 includes a connector for coupling the framework to the tower; one or more rigid support members, and one or more connecting members to connect the rigid support members to the connector. The rigid support members span the length of the tower and help to support the bending load on the tower. The support structure is removable once the tower is raised. In another embodiment of the support structure, as illustrated in FIG. 9, a cable 210 spans the length of the tower 110 from the top to the bottom and is attached to opposing ends of the tower 110A, 110B. A hydraulic cylinder 200, positioned at the middle of the tower tensions the cable to counteract the bending forces caused during lifting of the tower 110.

Another embodiment of the invention comprises a method for erecting a tower. During the method, the tower is raised in two elevation phases. The first phase uses a lift initiator 120 or elevator 124 to push the top of the tower 112 away from a first plane that is parallel to the ground, to a second plane that defines an acute angle to the ground.

During the second phase, a primary lift assembly is used to pull the tower from the second plane to a vertical plane. The primary lift assembly includes a continuous loop of cable, a counter-balanced tackle-block system (described above), and a winch. The winch raises the tower by pulling on a continuous loop of cable connected to the counter-balanced tackle-block system until the tower is in a vertical position.

The counter-balanced tackle-block system may be configured in several variations. In one configuration, the continuous loop of cable is directly coupled at a first end to the top end of the assembled wind turbine tower and at a second end to the top end of the assembled wind turbine tower opposite the first end (on the other side of the tower). In this configuration, lifting the assembled tower from the second plane to the vertical plane comprises driving the continuous loop of cable to decrease the distance between the first end of the cable and the stationary block while increasing the distance between the second end of the cable and the counter-lift block.

In another configuration, a traveling block is coupled to the top end of the assembled wind turbine tower and a continuous loop of cable passes through the traveling block, a stationary block, and a counter-lift block. The continuous loop of cable includes a first end coupled to the static line anchor and a second end coupled to the top end of the assembled wind turbine tower opposite the traveling block. In this configuration, lifting the assembled wind turbine tower from the second plane to the vertical plane comprises driving the continuous loop of cable to decrease the distance between the traveling block and the stationary block while increasing the distance between the second end of the cable and the counter-lift block.

In a third configuration, a first traveling block is coupled to the top end of the assembled wind turbine tower and a second traveling block is coupled to the top end of the assembled wind turbine tower opposite the first traveling block. A continuous loop of cable passes through the first traveling block, a stationary block, a counter-lift block, and the second traveling block. The continuous loop of cable includes a first end coupled to a first static line anchor and a second end coupled to a second static line anchor. In this configuration, lifting the assembled wind turbine tower from the second plane to the vertical plane comprises driving the continuous loop of cable to decrease the distance between the first traveling block and the stationary block while increasing the distance between the second traveling block and the counter-lift block.

The method may also comprise counteracting increases or decreases in tension utilizing a tensioning system. Lifting the assembled tower from the second plane to a vertical plane may also include temporarily reinforcing the tower for the lift. This is carried out by providing a support cable comprising a middle, a first end, and a second end. The method further includes connecting the first end of the support cable to the top end of the wind turbine tower; connecting the second end of the support cable to the bottom end of the wind turbine tower; and applying force to the middle of the wind turbine tower while lifting the assembled wind turbine tower from the second plane using the middle of the cable as a reaction point to counteract bending forces acting on the assembled wind turbine tower.

The method may also include orienting the tower by positioning the tower in a horizontal and vertical direction. A setting trolley equipped with wheels, tracks, slides, or casters can be used to position the tower in the horizontal direction. A hydraulic system, rack and pinion, or a screw jack can be used to position the tower in the vertical.

In some aspects of the invention, after the assembled tower is raised to a vertical position, the base of the assembled tower is first oriented upon a foundation to which the assembled tower is to be coupled and then lowered onto the foundation. The tower may also be stabilized. Stabilizing the tower may be carried out by anchoring one or more guy lines to anchor points and tensioning the guy lines. Tensioning the guy lines may be carried out by activating a cylinder powered by hydraulics, pneumatics, or electricity.

The method further includes coupling the assembled tower to the foundation. Coupling the assembled tower to the foundation may be carried out by placing the tower in a recessed cavity or on top of a protruding structure; fastening one or more connectors such as nuts and bolts, flanges, brackets, and the like; applying cements, grouts, adhesives, and so on; or by any other means as is well known in the art.

Another embodiment is a method of preparing a primary lift assembly for erecting an assembled tower, as described above. The method is carried out by setting a first anchor point and a second anchor point and connecting a stationary block connected to the first anchor point and a first tensioning system to the stationary block. The method further includes connecting a counter-lift block to the second anchor point and connecting a second tensioning system to the counter-lift block. The method also includes passing a continuous loop of cable through the stationary block and the counter-lift block and coupling the continuous loop of cable to the top of the assembled tower on two opposing sides.

It should be understood that the inventive concepts disclosed herein are capable of many modifications. Such modifications may include types of materials, specific tools and mechanisms used, and so on. To the extent such modifications fall within the scope of the appended claims and their equivalents, they are intended to be covered by this patent.

The invention claimed is:

1. A method for erecting a tower, the method comprising:

assembling sections of a tower proximate to the ground, the sections comprising a base section, a top section, and one or more intermediate sections between the base section and the top section, the tower, when assembled, lying in a substantially horizontal first plane, to a second plane, the assembled tower comprising a top end including the top section and a bottom end including the base section;

orienting the attitude of the assembled tower, utilizing a lift initiator, to lie in the second plane, the second plane defining an acute angle to the first plane so that the top end of the tower is higher in elevation than the bottom end, the lift initiator further comprising a pushing mechanism; and lifting the assembled tower from the second plane to a vertical plane with a pulley system, the pulley system comprising a primary lift assembly.

2. The method of claim 1 wherein the primary lift assembly comprises a continuous loop of cable connected to a counter-balanced tackle-block system and the step of lifting the assembled tower from the second plane to the vertical plane comprises:

driving the continuous loop of cable connected to the counter-balanced tackle-block system until the tower is in the vertical position.

3. The method of claim 2 wherein the step of lifting the assembled tower from the second plane to a vertical plane with the primary lift assembly comprises:

connecting a stationary block to a first anchor point proximate the bottom section of a first side of the assembled tower;

connecting a counter-lift block to a second anchor point proximate the bottom section of a second side of the assembled tower, the counter-lift block in a same plane as the stationary blocks;

passing the continuous loop of cable through the stationary block and the counter-lift block, the continuous loop of cable comprising a first end coupled to the top end of the assembled tower and a second end coupled to the top end of the assembled tower opposite the first end; and driving the continuous loop of cable to decrease the distance between the first end of the cable and the stationary block while increasing the distance between the second end of the cable and the counter-lift block.

4. The method of claim 2 wherein the step of lifting the assembled tower from the second plane to the vertical plane with a primary lift assembly comprises:

connecting the stationary block to a first anchor point proximate the bottom section of the first side of the assembled tower;

connecting the counter-lift block to a second anchor point proximate the bottom section of a second side of the assembled tower, the counter-lift block in a same plane as the stationary block;

coupling a traveling block to the top end of the assembled tower;

anchoring a static line at a third anchor point proximate the stationary block;

passing the continuous loop of cable through the traveling block, the stationary block, and the counter-lift block, the continuous loop of cable comprising a first end coupled to the static line anchor and a second end coupled to the top end of the assembled tower opposite the traveling block; and driving the continuous loop of cable to decrease the distance between the traveling block and the stationary block while increasing the distance between the second end of the cable and the counter-lift block.

5. The method of claim 3 wherein the step of lifting the assembled tower from the second plane to the vertical plane with the primary lift assembly further comprises:

connecting the stationary block to a first anchor point proximate the bottom section of a first side of the assembled tower;

connecting the counter-lift block to a second anchor point proximate the bottom section of a second side of the assembled tower, the counter-lift block in a same plane as the stationary block;

coupling a first traveling block to the top end of the assembled tower;

coupling a second traveling block to the top end of the assembled tower opposite the first traveling block;

anchoring a first static line at the third anchor point proximate the stationary block;

anchoring a second static line at a fourth anchor point proximate the counter-lift block;

passing the continuous loop of cable through the first traveling block, the stationary block, the counter-lift block, and the second traveling block, the continuous loop of cable including a first end coupled to the first static line anchor and a second end coupled to the second static line anchor; and driving the continuous loop of cable to decrease the distance between the first traveling block and the stationary block while increasing the distance between the second traveling block and the counter-lift block.

6. The method of claim 5 wherein the stationary block is connected to the first anchor point through a first tensioning system, wherein lifting the assembled tower from the second plane to the vertical plane further comprises counteracting increases in tension at the first end of the cable utilizing the first tensioning system.

7. The method of claim 5 wherein the counter-lift block is connected to the second anchor point through a second tensioning system, wherein lifting the assembled tower from the second plane to the vertical plane further comprises counteracting decreases in tension on the second end of the cable utilizing the second tensioning system.

8. The method of claim 1, wherein lifting the assembled tower from the second plane to the vertical plane comprises temporarily reinforcing the tower to counteract bending forces.

9. The method of claim 1, wherein lifting the assembled tower from the second plane to the vertical plane comprises:

providing a support cable comprising a middle, a first end, and a second end;

connecting the first end of the support cable to the top end of the assembled tower;

connecting the second end of the support cable to the bottom end of the assembled tower; and applying force to the middle of the assembled tower while lifting the assembled tower from the second plane using the middle of the cable as a reaction point to counteract bending forces acting on the assembled tower.

10. The method of claim 1, wherein the step of lifting the assembled tower comprises lifting an assembled tower that is 75 feet or more in height.

11. The method of claim 1, wherein the assembled tower is a wind turbine tower further comprising a rotor coupled to a nacelle, the method further comprising attaching the nacelle to the top section and the rotor to the nacelle prior to lifting the assembled wind turbine tower from the horizontal plane to the vertical plane.

12. The method of claim 1, wherein the step of lifting the assembled tower comprises lifting an assembled tower for use in a petrochemical industry, a refining industry or a utility industry for transmission of electrical power.

13. The method of claim 5 further comprising:

setting a first anchor point and a second anchor point;

connecting the stationary block connected to the first anchor point;

connecting the first tensioning system to the stationary block;

connecting the counter-lift block to the second anchor point;

connecting the second tensioning system to the counter-lift block;

passing the continuous loop of cable through the stationary block and the counter-lift block; and coupling the continuous loop of cable to the top of the assembled tower on two opposing sides.

14. The method of claim 13, wherein coupling the continuous loop of cable to the top of the assembled tower on two opposing sides comprises coupling the continuous loop of cable to the top of the assembled tower on a first side with a first set of traveling blocks and coupling the continuous loop of cable to the top of the assembled tower on a second side opposite the first side with a second set of traveling blocks.

15. A method for erecting a tower, the method comprising:

assembling sections of a tower proximate to the ground, the assembled tower comprising a height greater than 75 feet and the sections comprising a base section, a top section, and one or more intermediate sections between the base section and the top section, the tower, when assembled, lying in a substantially horizontal first plane, to a second plane, the assembled tower comprising a top end including the top section and a bottom end including the base section;

orienting the attitude of the assembled tower, utilizing a lift initiator, to lie in the second plane, the second plane defining an acute angle to the first plane so that the top end of the tower is higher in elevation than the bottom end, the lift initiator further comprising a pushing mechanism; and lifting the assembled tower from the second plane to a vertical plane with a pulley system, the pulley system comprising a primary lift assembly.

16. The method of claim 15 wherein lifting the assembled tower from the second plane to the vertical plane comprises:

providing a support cable comprising a middle, a first end, and a second end;

connecting the first end of the support cable to the top end of the assembled tower;

connecting the second end of the support cable to the bottom end of the assembled tower; and applying force to the middle of the assembled tower while lifting the assembled tower from the second plane using the middle of the cable as a reaction point to counteract bending forces acting on the assembled tower.

* * * * *